US010435771B2

(12) United States Patent
Parrish et al.

(10) Patent No.: US 10,435,771 B2
(45) Date of Patent: Oct. 8, 2019

(54) ALUMINUM-TITANIUM-VANADIUM-ZIRCONIUM-NIOBIUM ALLOY COMPOSITION FOR HIGH TEMPERATURE APPLICATIONS

(71) Applicant: The Boeing Company, Chicago, IL (US)

(72) Inventors: Catherine J. Parrish, San Jose dos Campos (BR); Carlos Angelo Nunes, Lorena (BR); Gilberto Carvalho Coelho, Lorena (BR); James D. Cotton, Issaquah, WA (US); Nabil Chaia, Lorena (BR); Jose Mauro Moraes, Jr., Lorena (BR)

(73) Assignee: The Boeing Company, Chicago, IL (US)

( * ) Notice: Subject to any disclaimer, the term of this patent is extended or adjusted under 35 U.S.C. 154(b) by 777 days.

(21) Appl. No.: 15/237,935

(22) Filed: Aug. 16, 2016

(65) Prior Publication Data

US 2018/0051361 A1 Feb. 22, 2018

(51) Int. Cl.
*C22C 30/00* (2006.01)

(52) U.S. Cl.
CPC ..... *C22C 30/00* (2013.01)

(58) Field of Classification Search
CPC ..... C22C 30/00
See application file for complete search history.

(56) References Cited

U.S. PATENT DOCUMENTS 4,440,736 A * 4/1984 Maeland ..... C01B 3/0031 148/421
2002/0159914 A1* 10/2002 Yeh ..... C22C 1/02 420/580
2016/0326616 A1* 11/2016 Park ..... C22C 30/00

OTHER PUBLICATIONS

Senkov et al., "Refractory high-entropy alloys," *Intermetallics*, No. 18, pp. 1758-1765 (2010).
Senkov et al., "Microstructure and room temperature properties of a high-entropy TaNbHfZrTi alloy," *Journal of Alloys and Compounds*, No. 509, pp. 6043-6048 (2011).
Liu et al., "Microstructure and oxidation behavior of new refractory high entropy alloys," *Journal of Alloys and Compounds*, No. 583, pp. 162-169 (2014).
Stepanov et al., "Effect of Al on structure and mechanical properties of $Al_xNbTiVZr$ (x=0, 0.5, 1, 1.5) high entropy alloys," *Materials Science and Technology*, 31:10, pp. 1184-1193 (2015).
Yeh et al., "Nanostructured High-entropy Alloys with Multiple Principal Elements: Novel Alloy Design Concepts and Outcomes," *Advanced Engineering Materials*, vol. 6, No. 5 (2004).
Senkov et al., "Mechanical Properties of $Nb_{25}Mo_{25}Ta_{25}W_{25}$ and $V_{20}Nb_{20}Mo_{20}Ta_{20}W_{20}$ refractory high entropy alloys," *Intermetallics*, No. 19, pp. 698-706 (2011).

* cited by examiner

*Primary Examiner* — Christopher S Kessler
(74) *Attorney, Agent, or Firm* — Walters & Wasylyna LLC

(57) ABSTRACT

An alloy composition that includes about 1 to about 9 atomic percent aluminum (Al), about 25 to about 33 atomic percent titanium (Ti), about 10 to about 33 atomic percent vanadium (V), about 5 to about 10 atomic percent zirconium (Zr) and about 25 to about 33 atomic percent niobium (Nb).

20 Claims, 11 Drawing Sheets

ALUMINUM-TITANIUM-VANADIUM-ZIRCONIUM-NIOBIUM ALLOY COMPOSITION FOR HIGH TEMPERATURE APPLICATIONS

FIELD

This application generally relates to high temperature alloy compositions and, more particularly, to multi-principle-element alloy compositions for high temperature applications and, even more particularly, to aluminum-titanium-vanadium-zirconium-niobium (Al—Ti—V—Zr—Nb) alloy compositions.

BACKGROUND

Various aerospace applications demand the use of superalloys due to their mechanical strength and creep resistance at elevated temperatures. For example, superalloys are incorporated into various structural components of aircraft, particularly structural components exposed to elevated temperatures, as well as in aircraft engines (e.g., turbine blades).

The nickel-based superalloy Inconel 625 is one of the more commonly used superalloys for high temperature aerospace applications. Inconel 625 includes nickel (Ni) as the primary alloying element, with additions of chromium (Cr), molybdenum (Mo) and niobium (Nb), among other possible elements. Because nickel is relatively heavy as compared to other common primary alloying elements (e.g., titanium (Ti)), Inconel 625 is relatively dense, thereby compromising its strength-to-weight ratio.

For even higher temperature aerospace applications, the niobium-based alloy C-103 is commonly substituted for Inconel 625. C-103 includes niobium (Nb) as the primary alloying element, with additions of hafnium (Hf) and titanium (Ti). However, C-103 is also relatively dense and has less strength than Inconel 625.

Thus, the high temperature alloys presently available for structural applications offer strength, but at the expense of significant weight. With the current mature state of single-principle-element alloy systems, a 10 to 15 percent increase in specific strength is considered difficult to achieve and generally not cost effective.

Accordingly, those skilled in the art continue with research and development efforts in the field of alloy compositions.

SUMMARY

In one embodiment, the disclosed alloy composition includes, for example, about 1 to about 9 atomic percent aluminum (Al), about 25 to about 33 atomic percent titanium (Ti), about 10 to about 33 atomic percent vanadium (V), about 5 to about 10 atomic percent zirconium (Zr) and about 25 to about 33 atomic percent niobium (Nb)

In another embodiment, the disclosed alloy composition includes, for example, about 2 to about 8 atomic percent aluminum (Al), about 25 to about 33 atomic percent titanium (Ti), about 10 to about 33 atomic percent vanadium (V), about 5 to about 10 atomic percent zirconium (Zr) and about 25 to about 33 atomic percent niobium (Nb).

In another embodiment, the disclosed alloy composition includes, for example, about 2 to about 8 atomic percent aluminum (Al), about 27 to about 31 atomic percent titanium (Ti), about 15 to about 30 atomic percent vanadium (V), about 6 to about 10 atomic percent zirconium (Zr) and about 27 to about 31 atomic percent niobium (Nb).

In yet another embodiment, the disclosed alloy composition includes, for example, about 3 to about 8 atomic percent aluminum (Al), about 28 to about 30 atomic percent titanium (Ti), about 20 to about 30 atomic percent vanadium (V), about 6 to about 9 atomic percent zirconium (Zr) and about 28 to about 30 atomic percent niobium (Nb).

Other embodiments of the disclosed multi-principle-element alloy composition will become apparent from the following detailed description, the accompanying drawings and the appended claims.

DETAILED DESCRIPTION

Figure 1:
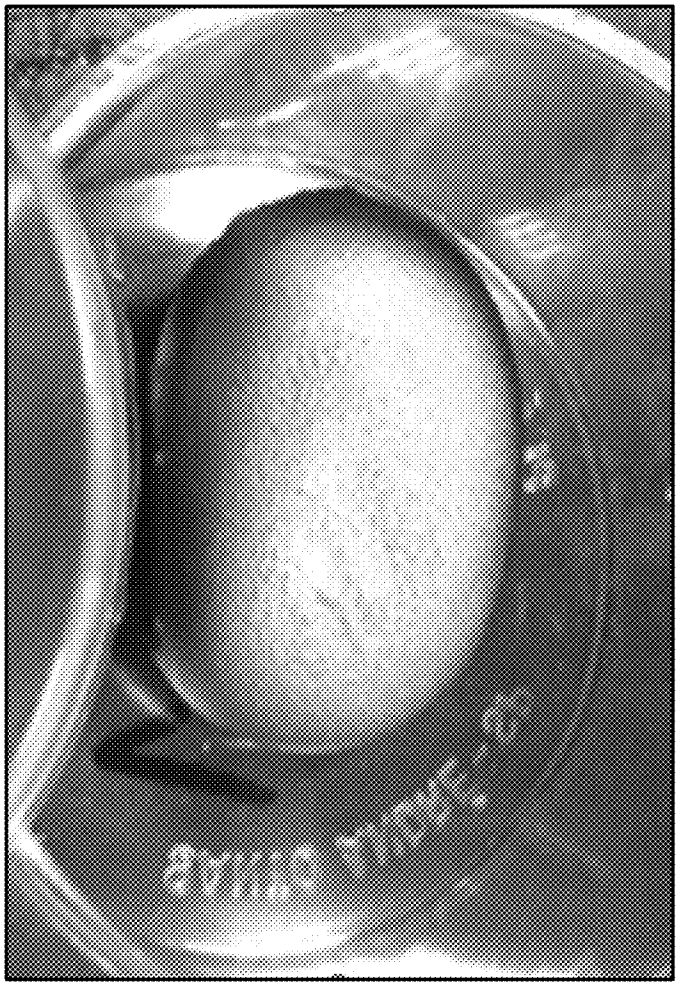
FIG. 1 is a photograph of an ingot having the disclosed multi-principle-element alloy composition.

Disclosed is a multi-principle-element alloy composition that may be used for high temperature applications. Considering the nickel-based superalloy Inconel 625 as the baseline, the disclosed multi-principle-element alloy composition offers a significant increase in specific strength at a lower density, while maintaining microstructural stability at elevated temperatures. Therefore, the disclosed multi-principle-element alloy composition may be well suited for use in various high temperature aerospace applications, as well as in various non-aerospace applications.

In a first embodiment, disclosed is a multi-principle-element alloy having the composition shown in Table 1.

TABLE 1

| Element | Range (at %) |
|---|---|
| Aluminum | 1-9 |
| Titanium | 25-33 |
| Vanadium | 10-33 |
| Zirconium | 5-10 |
| Niobium | 25-33 |

Those skilled in the art will appreciate that various impurities, which do not substantially affect the physical properties of the multi-principle-element alloy of the first embodiment, may also be present, and the presence of such impurities will not result in a departure from the scope of the present disclosure. For example, the impurities content of the multi-principle-element alloy of the first embodiment may be controlled as shown in Table 2.

TABLE 2

| Impurity | Maximum (at %) |
|---|---|
| Carbon | 0.1 |
| Nitrogen | 0.1 |
| Iron | 0.1 |
| Nickel | 0.1 |
| Magnesium | 0.1 |
| Other Elements, Each | 0.1 |
| Other Elements, Total | 1.0 |

Thus, the multi-principle-element alloy of the first embodiment may consist essentially of aluminum (Al), titanium (Ti), vanadium (V), zirconium (Zr) and niobium (Nb).

In a second embodiment, disclosed is a multi-principle-element alloy having the composition shown in Table 3.

TABLE 3

| Element | Range (at %) |
|---|---|
| Aluminum | 2-8 |
| Titanium | 25-33 |
| Vanadium | 10-33 |
| Zirconium | 5-10 |
| Niobium | 25-33 |

The impurities content of the multi-principle-element alloy of the second embodiment may be controlled as shown in Table 2. Thus, the multi-principle-element alloy of the second embodiment may consist essentially of aluminum (Al), titanium (Ti), vanadium (V), zirconium (Zr) and niobium (Nb).

In a third embodiment, disclosed is a multi-principle-element alloy having the composition shown in Table 4.

TABLE 4

| Element | Range (at %) |
|---|---|
| Aluminum | 2-8 |
| Titanium | 27-31 |
| Vanadium | 15-30 |
| Zirconium | 6-10 |
| Niobium | 27-31 |

The impurities content of the multi-principle-element alloy of the third embodiment may be controlled as shown in Table 2. Thus, the multi-principle-element alloy of the third embodiment may consist essentially of aluminum (Al), titanium (Ti), vanadium (V), zirconium (Zr) and niobium (Nb).

In a fourth embodiment, disclosed is a multi-principle-element alloy having the composition shown in Table 5.

TABLE 5

| Element | Range (at %) |
|---|---|
| Aluminum | 3-8 |
| Titanium | 28-30 |
| Vanadium | 20-30 |
| Zirconium | 6-9 |
| Niobium | 28-30 |

The impurities content of the multi-principle-element alloy of the fourth embodiment may be controlled as shown in Table 2. Thus, the multi-principle-element alloy of the fourth embodiment may consist essentially of aluminum (Al), titanium (Ti), vanadium (V), zirconium (Zr) and niobium (Nb).

The disclosed multi-principle-element alloys may be used to manufacture various articles, such as aircraft parts and components, using traditional casting or forging processes, or hybrid processes such as powder metallurgy combined with forging, or rolling, or extrusion, or welding (solid state (linear or rotational friction or inertia) or traditional melting fusion or with filler). Additionally, the disclosed multi-principle-element alloys may be used for various net shape and near net shape fabrication processes such as additive manufacturing laser, electron beam, plasma arc melting techniques and powder metallurgy additive laser or electron beam sintering techniques.

EXAMPLES

Ingots of Al—Ti—V—Zr—Nb alloys were produced by arc melting charges of 10 g using high purity elements (minimum 99.8%) under inert argon atmosphere (minimum 99.995%) on a water cooled copper crucible using a non-consumable tungsten electrode. Two alloys were produced, Example 1 and a Comparative Example, as shown in Table 6.

TABLE 6

| | Target (at %) | |
|---|---|---|
| Element | Example 1 | Comparative Example |
| Aluminum | 8 | 20 |
| Titanium | 29 | 20 |
| Vanadium | 28 | 20 |
| Zirconium | 8 | 20 |
| Niobium | 27 | 20 |

Prior to the preparation of the alloys, a titanium button used as a getter was melted with the aim of removing residual oxygen, nitrogen and hydrogen from the furnace chamber. To ensure a good chemical homogeneity, the ingots were flipped over and remelted at least five times. Projections and volatilization of elements during the melting were negligible and the maximum mass losses were about 0.5%. An initial heat treatment was carried out at 1200° C. for 24 hours. An exposure treatment at 700° C. was performed for 7 days to evaluate the stability of the microstructures at this temperature. This temperature was selected based on the upper limits of propulsion structures in commercial applications, and pushes just beyond the temperature range where Ti alloys are typically viable. In that sense, it is just a thermal exposure to simulate an application. The annealing and exposure treatments were performed by introducing the samples into silica quartz tubes gettered with zirconium chips and sealed under primary vacuum ($3\times10^{-2}$ mbar) to prevent oxidation. At the end of the treatment duration, the tubes were removed from the furnace and cooled down in static air to room temperature.

The as-cast and annealed alloys were characterized by conventional techniques. Microstructure and phase composition of the alloys were studied using X-Ray Diffraction ("XRD"), scanning electron microscopy ("SEM") and Energy Dispersive Spectroscopy ("EDS") to determine the chemical composition. For the SEM analyses, the samples were hot mounted in phenolic resin, grinded with SiC paper (#120 to #2400) and polished using 1 μm colloidal alumina suspension. The XRD analyses were performed using a Panalytical Empyrean diffractometer with Cu $K_\alpha$ radiation on polished cross sections of the samples. Investigations by SEM were performed using a HITACHI TM3000 tabletop microscope equipped with an energy dispersive (EDS) detector.

Hardness values of the alloys were determined using a 6020 MicroMet-Tester from Bulher using a Vickers type indenter applying a 500 g load for 20 s.

Room temperature compression tests were performed on exposed samples (700° C./7 days) using an EMIC 100 kN machine, under $3\times10^{-3}$ $s^{-1}$ strain rate. Samples of dimensions 4.0 mm diameter by 8.0 mm long were obtained by conventional machining from exposed ingots.

As-Cast Alloys

As shown in FIG. 1, the produced ingots presented metallic aspect with no indication of oxidation. In the initial trials, regions of unmelted material, likely niobium, was observed in cross-section views, a problem which was solved by altering the melting procedure.

Figure 2A:
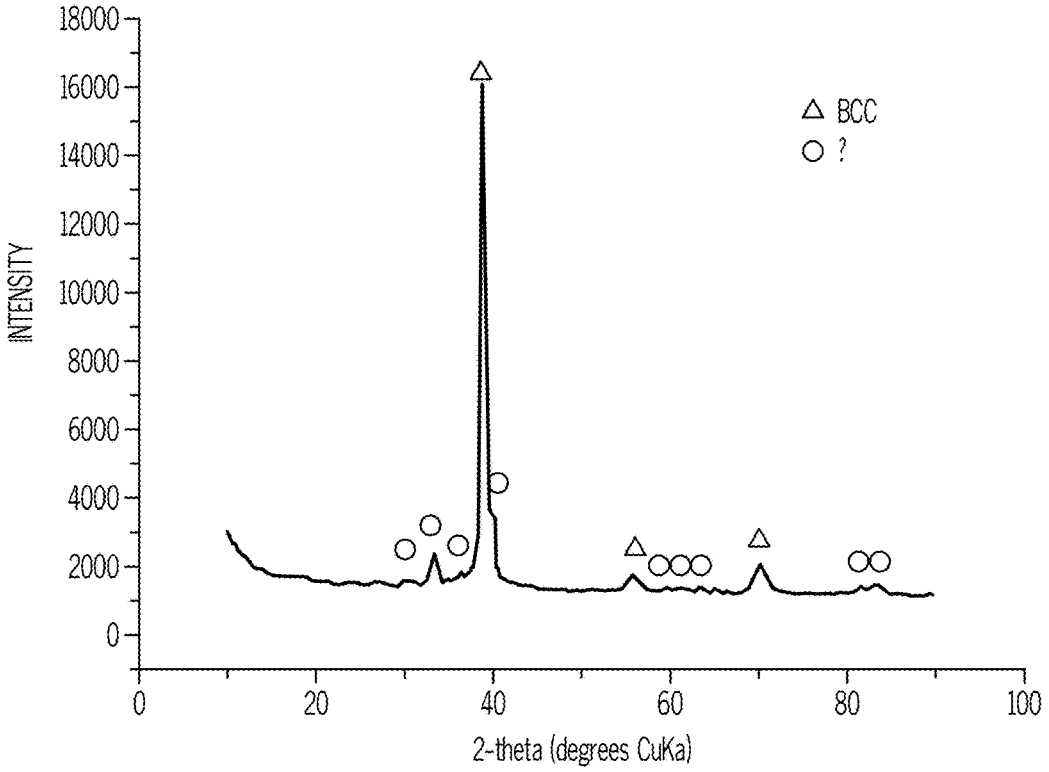
FIGS. 2A and 2B are x-ray diffraction patterns of as-cast alloys having the disclosed multi-principle-element alloy composition (FIG. 2B) and a comparative example composition (FIG. 2A)
Figure 2B:
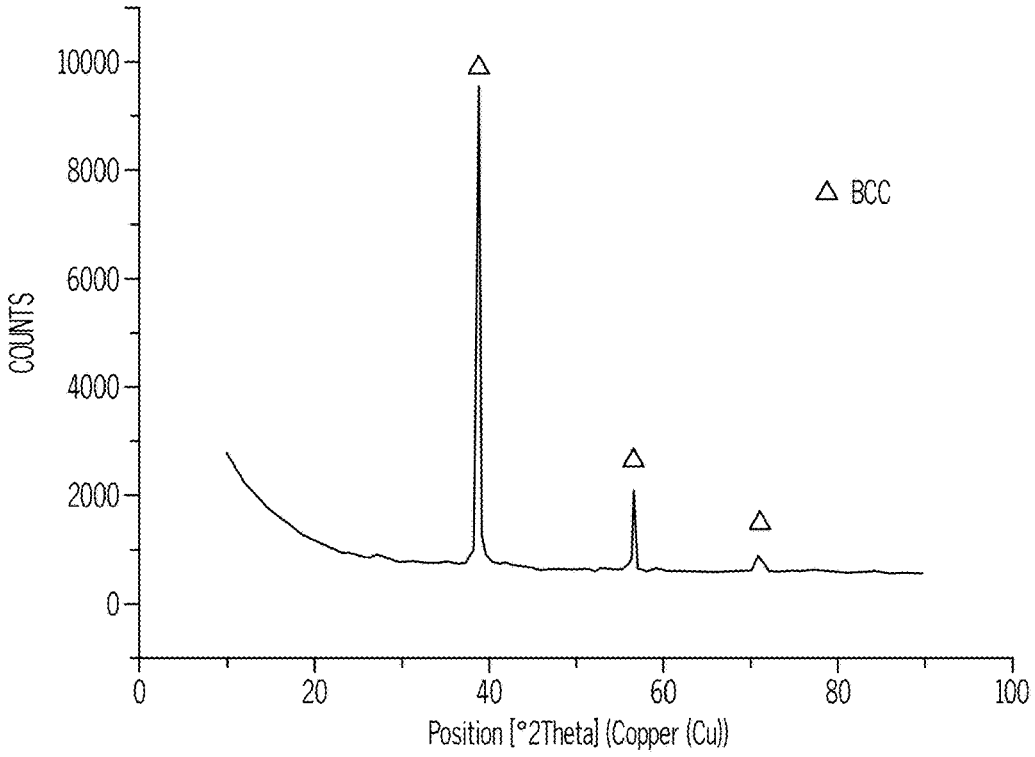

The XRD patterns collected from the as-cast alloys are shown in FIG. 2. The Comparison Example alloy (FIG. 2*a*) is composed mainly of a BCC phase and other minor phase(s) of which the peaks are not yet well identified. The X-ray diffractogram of the alloy of Example 1 is shown in FIG. 2B. The results indicate a BCC single-phase microstructured alloy based on the XRD results.

Figure 3A:
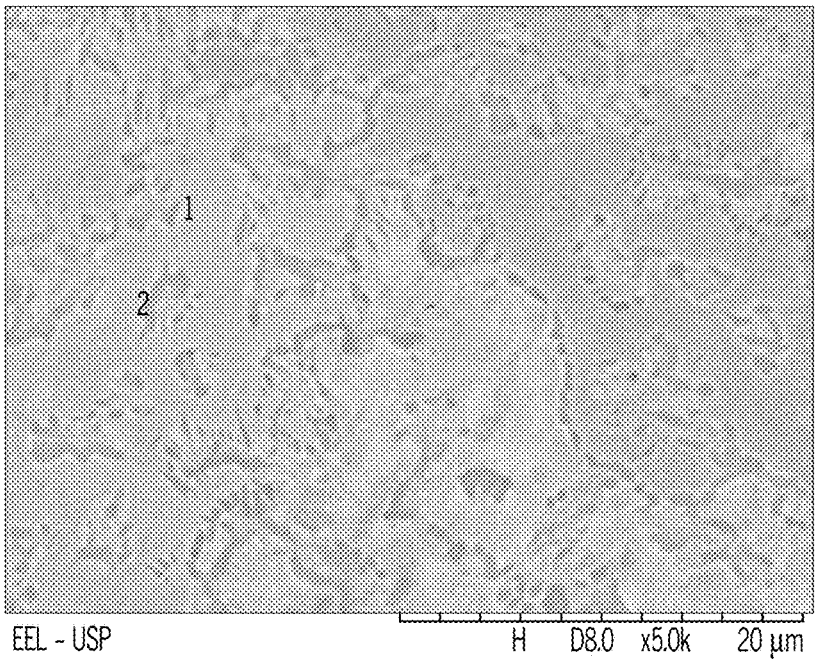
FIGS. 3A and 3B are scanning electron microscopy (back scatter electron detector) micrographs of as-cast alloys having the disclosed multi-principle-element alloy composition (FIG. 3B) and a comparative example composition (FIG. 3A)
Figure 3B:
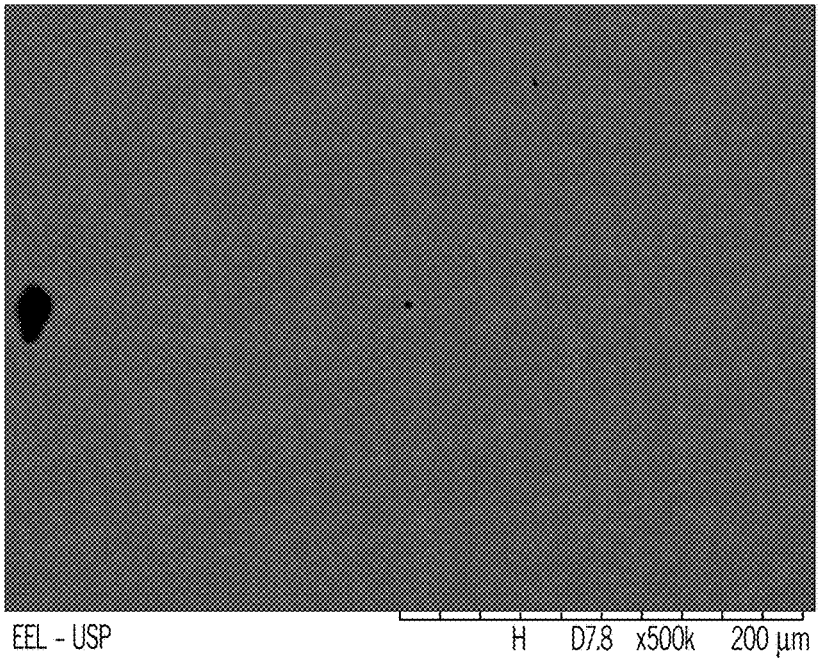

The microstructures of the as-cast alloys are presented in FIGS. 3A and 3B, and the EDS analysis (global and phase compositions) is presented in Table 7.

TABLE 7

| No. | Designation | Element (at. %) | | | | |
|---|---|---|---|---|---|---|
| | | Al | Ti | V | Zr | Nb |
| | | $Al_{20}Ti_{20}V_{20}Zr_{20}Nb_{20}$ | | | | |
| 1 | Matrix | 19.1 | 20.2 | 17.4 | 20.6 | 22.6 |
| 2 | Dark grey particles | 22.4 | 13.5 | 18.1 | 31.4 | 14.6 |
| | Alloy composition | 19.3 | 18.8 | 18.5 | 21.6 | 21.8 |
| | | $Al_8Ti_{29}V_{28}Zr_8Nb_{27}$ | | | | |
| | Alloy composition | 8.3 | 27.8 | 26.8 | 7.9 | 29.2 |

The Comparison Example alloy is composed of a matrix (point 1) and minor second phase(s) dispersed in this matrix (point 2), enriched with Al and Zr. The microstructure of the Example 1 alloy shows a segregated dendritic structure with no apparent presence of second phase(s). The inter-dendritic regions are enriched with Al and Zr, and partially depleted of Ti and Nb. These results are in good agreement and corroborate those obtained by XRD.

Alloys Annealed at 1200° C. for 24 Hours

Figure 4A:
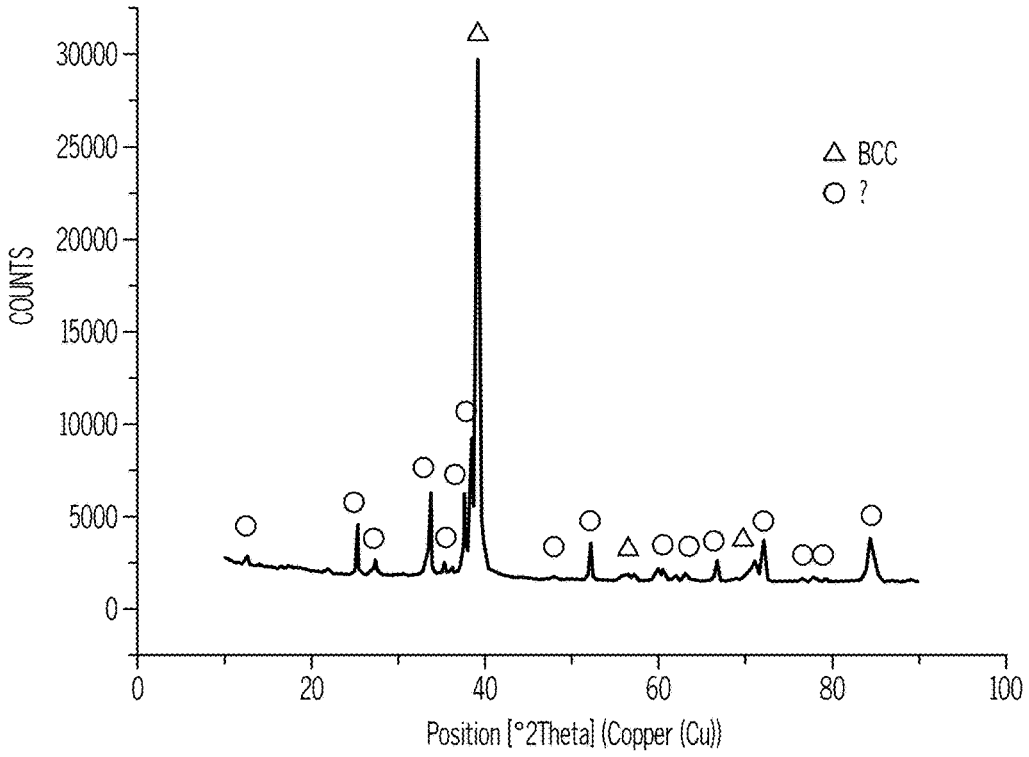
FIGS. 4A and 4B are x-ray diffraction patterns of annealed alloys having the disclosed multi-principle-element alloy composition (FIG. 4B) and a comparative example composition (FIG. 4A)
Figure 4B:
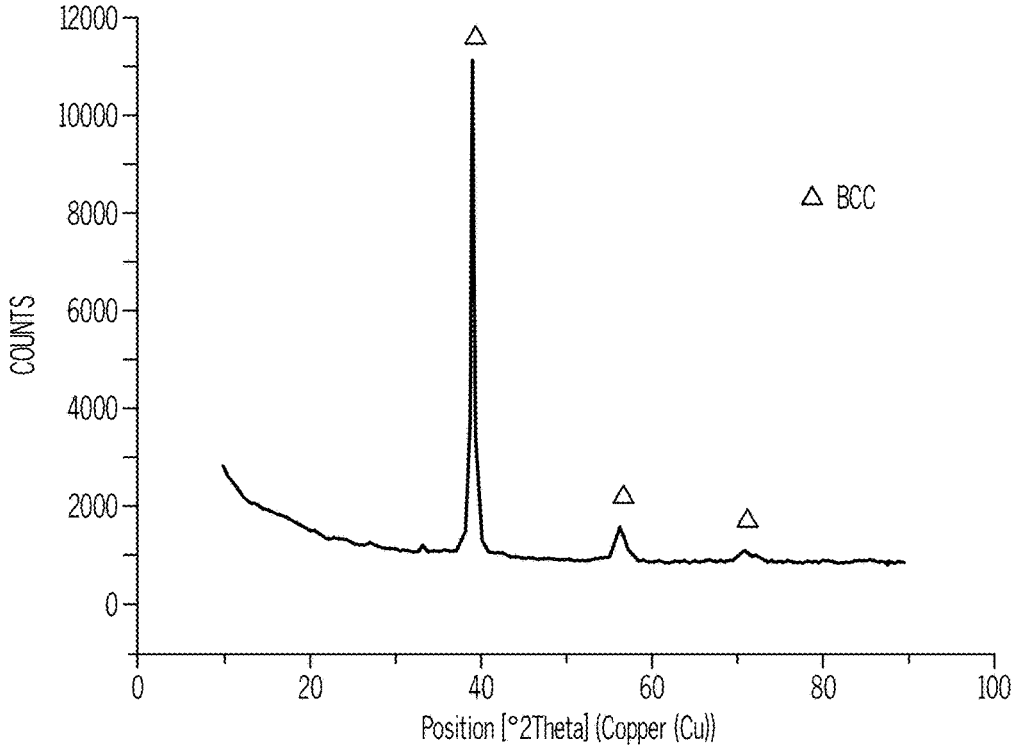
Figure 5A:
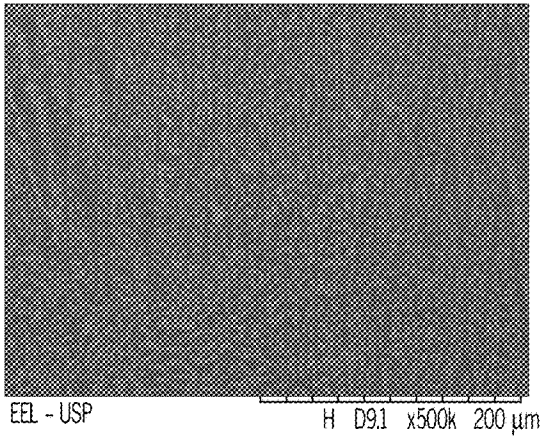
FIGS. 5A-5D are scanning electron microscopy (back scatter electron detector) micrographs of annealed alloys having the disclosed multi-principle-element alloy composition (FIGS. 5C and 5D) and a comparative example composition (FIGS. 5A and 5B)
Figure 5B:
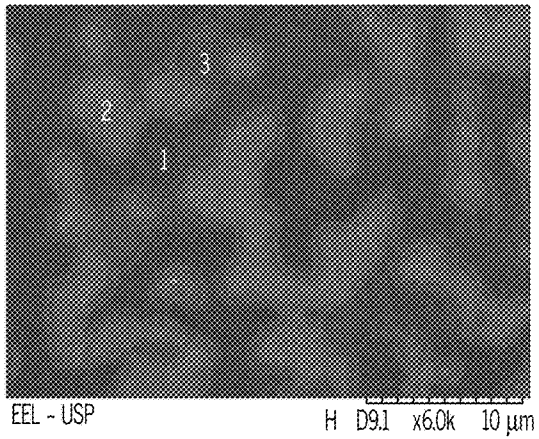
Figure 5C:
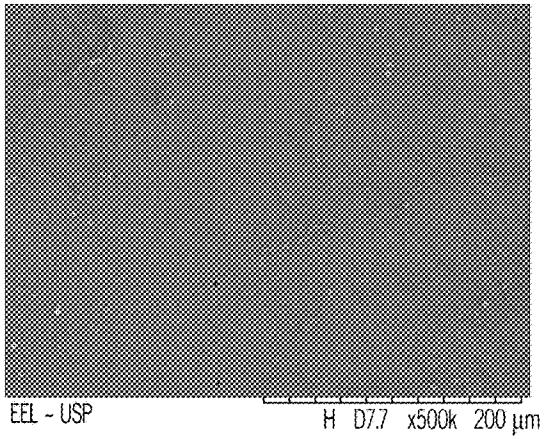
Figure 5D:
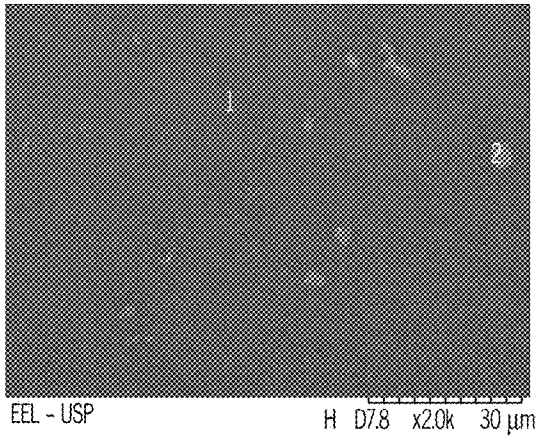

In order to eliminate the segregation of the as-cast microstructures, annealing heat treatments were performed at 1200° C. for 24 hours. The XRD patterns of the homogenized alloys are presented in FIGS. 4A and 4B. One can observe, for the Comparison Example alloy, the reflections related to the BCC phase and an increase of the intensity of the secondary phase(s). The Example 1 alloy remains composed only by the BCC phase, suggesting no important change in the microstructure.

Micrographs of the annealed samples are shown in the FIGS. 5A-5D. The microstructure of the Comparison Example alloy (FIGS. 5A and 5B) consists of a matrix (point 1) in which two minor phases precipitate: (i) light grey particles (point 2) and (ii) dark ones (point 3). The EDS chemical analysis (Table 8) revealed that the dark grey particles are enriched with Al, V and Zr while the light particles are composed mainly of Al and Zr.

TABLE 8

| No. | Designation | Element (at. %) | | | | |
|---|---|---|---|---|---|---|
| | | Al | Ti | V | Zr | Nb |
| | | $Al_{20}Ti_{20}V_{20}Zr_{20}Nb_{20}$ | | | | |
| 1 | Matrix | 12.6 | 24.9 | 24.5 | 10.6 | 27.4 |
| 2 | Light grey particles | 33 | 8.5 | 4.1 | 42.9 | 11.5 |
| 3 | Dark grey particles | 22 | 8.4 | 24.6 | 33.1 | 11.9 |
| | Alloy composition | 19.9 | 18.9 | 18.4 | 21.6 | 21.2 |
| | | $Al_8Ti_{29}V_{28}Zr_8Nb_{27}$ | | | | |
| 1 | Matrix | 8.3 | 28.2 | 26.7 | 7.7 | 29.1 |
| 2 | Light grey particles | 2 | 5.5 | 1.9 | 86.8 | 3.8 |
| | Alloy composition | 8.3 | 27.8 | 26.8 | 7.9 | 29.2 |

The Example 1 alloy (FIGS. 5C and 5D) presented as near single-phase. The matrix (point 1) corresponds to the BCC solid solution, however, minor precipitates of Zr-rich particles (light grey-point 2) are observed, mainly at the grains boundaries, based on EDS results (Table 8).

Alloys Exposed at 700° C. for 7 Days

Figure 6:
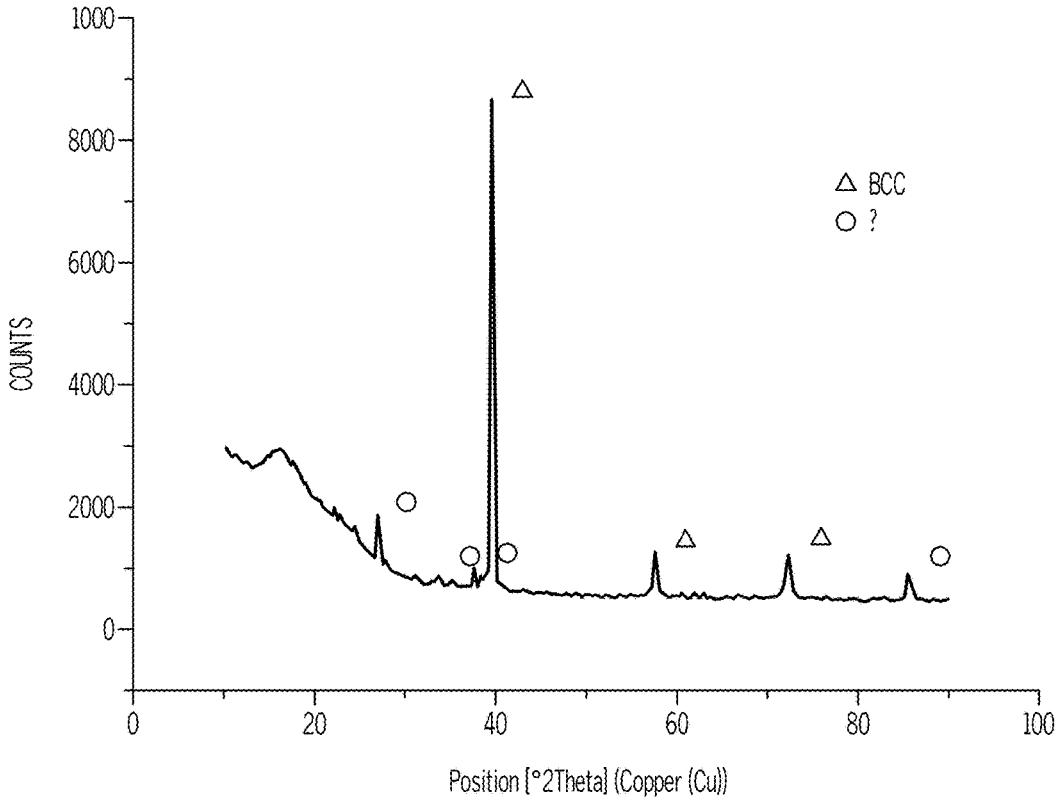
FIG. 6 is an x-ray diffraction pattern of the disclosed multi-principle-element alloy composition after an exposure treatment at 700° C. for 7 days.

FIG. 6 shows the XRD pattern of the Example 1 alloy after exposure at 700° C. for 7 days. The reflections from the BCC remains dominant, however, few extra peaks are observed, suggesting that some precipitation has occurred from the previously annealed (1200° C. for 24 h) sample, where such peaks were not observed (see FIG. 4B).

Figure 7A:
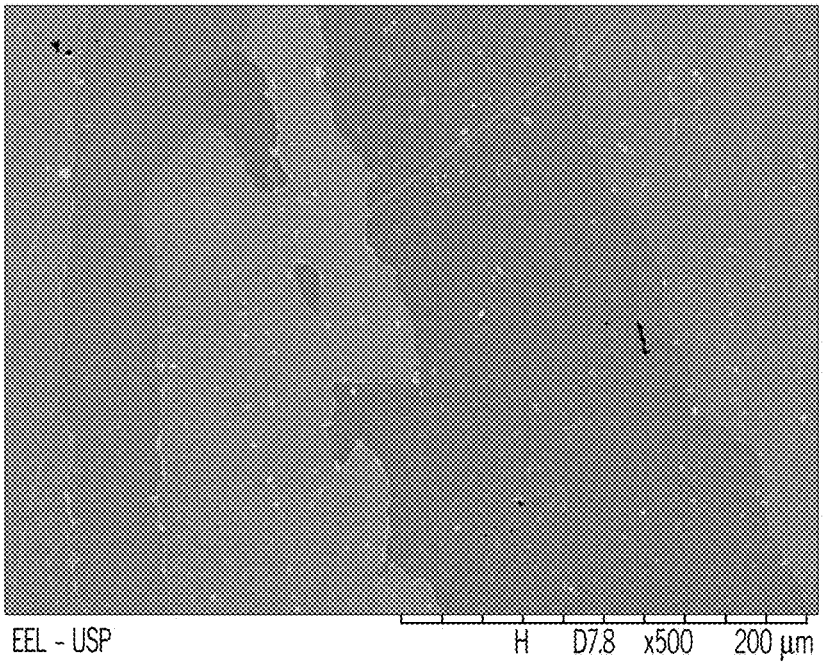
FIGS. 7A and 7B are scanning electron microscopy (back scatter electron detector) micrographs of the disclosed multi-principle-element alloy composition after an exposure treatment at 700° C. for 7 days.
Figure 7B:
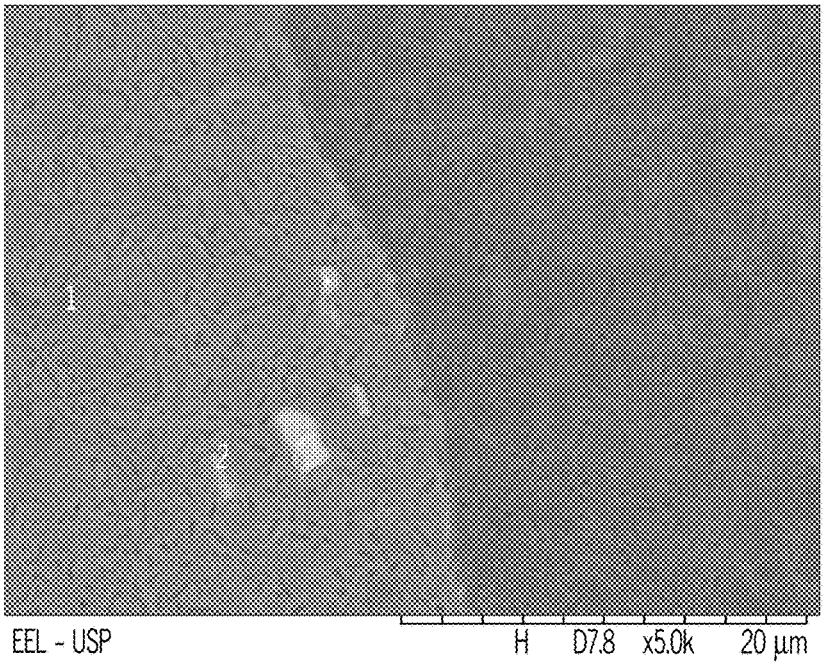

FIGS. 7A and 7B show SEM-BSE images of the heat-treated (700° C./7 days) Example 1 alloy. The microstructure of the alloy consists of a major matrix (point 1) and two types of second phase particles: light grey particles (point 2) and dark ones, revealed in higher magnification (FIG. 7B). EDS chemical analysis (Table 9) showed that the light grey particles are Zr-rich. However, the dark grey particles are very small to be accurately analyzed by EDS.

TABLE 9

| | | Element (at. %) | | | | |
|---|---|---|---|---|---|---|
| | | Al | Ti | V | Zr | Nb |
| 1 | Matrix | 6.9 | 29 | 28.2 | 5.3 | 30.6 |
| 2 | Light grey particles | 4.6 | 8.2 | 4.9 | 77.5 | 4.8 |
| | Alloy composition | 8 | 28.2 | 26.3 | 8 | 29.5 |

Density Data

Using the densities $\rho_i$ of pure elements ($A_i$) and the alloy compositions, the density $\rho_{mix}$ of the Example 1 and Comparative Example alloys were estimated using Equation 1:

$$\rho_{mix} = \frac{\sum c_i A_i}{\sum \frac{c_i A_i}{\rho_i}} \quad \text{(Eq. 1)}$$

The calculated densities are given in Table 10, as well as the actual densities for Inconel 718, Inconel 625 and C-103.

TABLE 10

| Alloy | Density ($g \cdot cm^{-3}$) |
|---|---|
| Comparative Example | 5.9 |
| Example 1 | 6.2 |
| Inconel 718 | 8.2 |
| C-103 | 8.9 |
| Inconel 625 | 8.4 |

As can be seen, the calculated densities of the Example 1 alloy (6.2 $g \cdot cm^{-3}$) and the Comparative Example (5.9 $g \cdot cm^{-3}$) alloy are considerably lower than that of Inconel 625 (8.4 $g \cdot cm^{-3}$).

Hardness and Compression Tests Data

The measured hardness values of the heat treated alloys are given in Table 11.

TABLE 11

| Ingot | Heat treatment | Average hardness [GPa] |
|---|---|---|
| Example 1 | 1200° C./24 h | 4.7 ± 0.12 |
| | 1200° C./24 h + 700° C./7 days | 3.5 ± 0.05 |
| Comparative Example | 1200° C./24 h | 4.9 ± 0.10 |
| | 700° C./7 days | 5.2 ± 0.11 |

After heat-treatment at 1200° C. for 24 hours, both alloys presented significant hardness values, around 5.0 GPa. The heat-treatment at 700° C. has not modified significantly the hardness value of the equimolar alloy. However, in the case of the Example 1 alloy, an important decrease has been observed, from 4.7 GPa to 3.5 GPa, likely associated to a decrease in the amount of Al and Zr in solid solution the BCC solid solution and consequent precipitation of secondary phases. This result shows the significant effect of solid solution hardening in strengthening these alloys.

Table 12 shows hardness, density and specific strength (hardness/density) of the produced alloys as well as those from reference alloys (Inconel 718; 15-5PH steel and C-103).

TABLE 12

| Ingot | Heat treatment | Average hardness [GPa] | Density ($g \cdot cm^{-3}$) | Specific Strength (Hardness/Density) |
|---|---|---|---|---|
| Comparative Example | 1200° C./24 h | 4.9 ± 0.10 | 5.9 | 0.83 |
| Example 1 | 1200° C./24 h | 4.7 ± 0.12 | 6.2 | 0.76 |
| | 1200° C./24 h + 700° C./7 days | 3.5 ± 0.05 | 6.2 | 0.56 |
| Inconel 718 | Various | 3.84-4.17 | 8.2 | 0.46-0.51 |
| 15-5PH | Various | 3.37-4.51 | 7.8 | 0.43-0.58 |
| C-103 Nb Alloy | Cold rolled | 2.26 | 8.9 | 0.25 |
| Inconel 625 | Annealed Sheet | 1.42-2.4 | 8.44 | 0.17-0.28 |

Figure 8A:
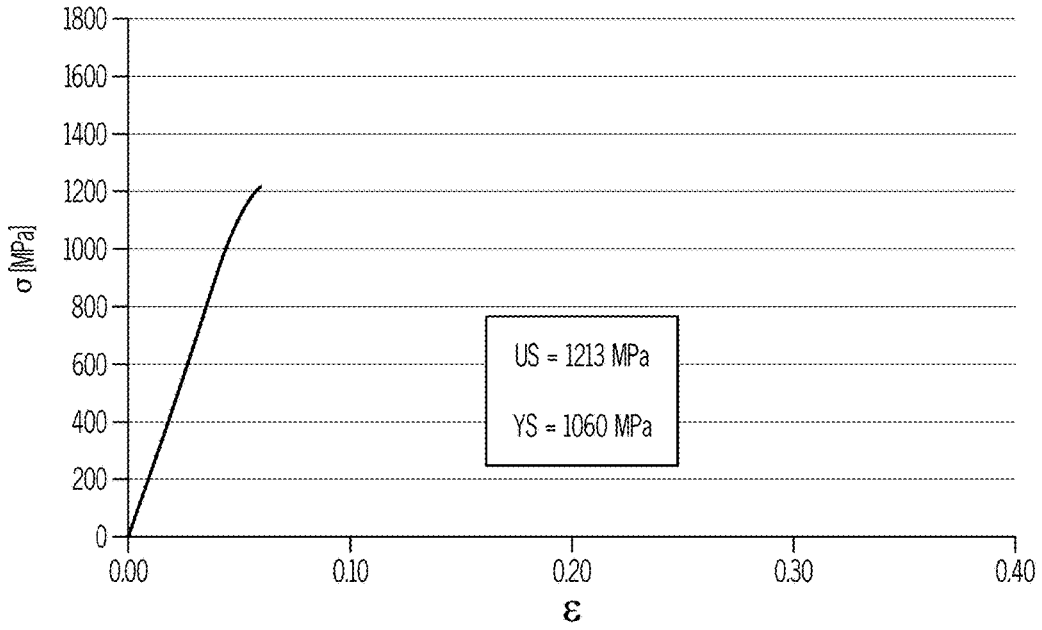
FIGS. 8A-8D are conventional stress-strain curves under compression (at room temperature) of samples having the disclosed multi-principle-element alloy composition (FIGS. 8C and 8D) and a comparative example composition (FIGS. 8A and 8B), wherein the samples were taken after an exposure treatment at 700° C. for 7 days.
Figure 8B:
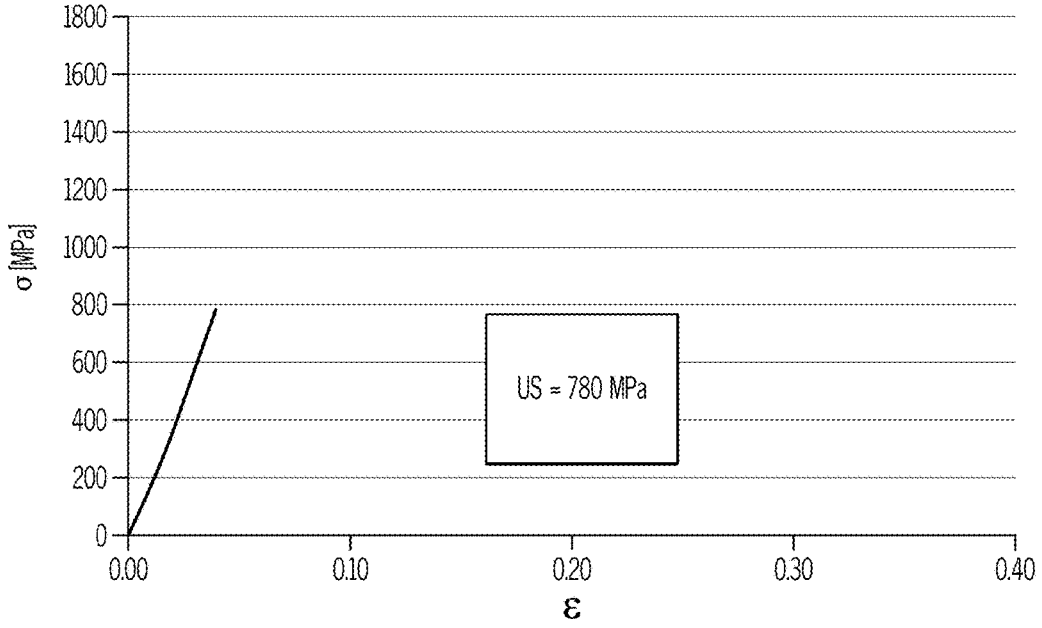

FIGS. 8A and 8B show stress-strain data under compression from two samples of the Comparative Example alloy. The lower yield strength was 800 MPa, with essentially no plastic deformation up to the fracture. A result likely associated to the large volume and intrinsic characteristics of the secondary phases present in the microstructure of this alloy.

Figure 8C:
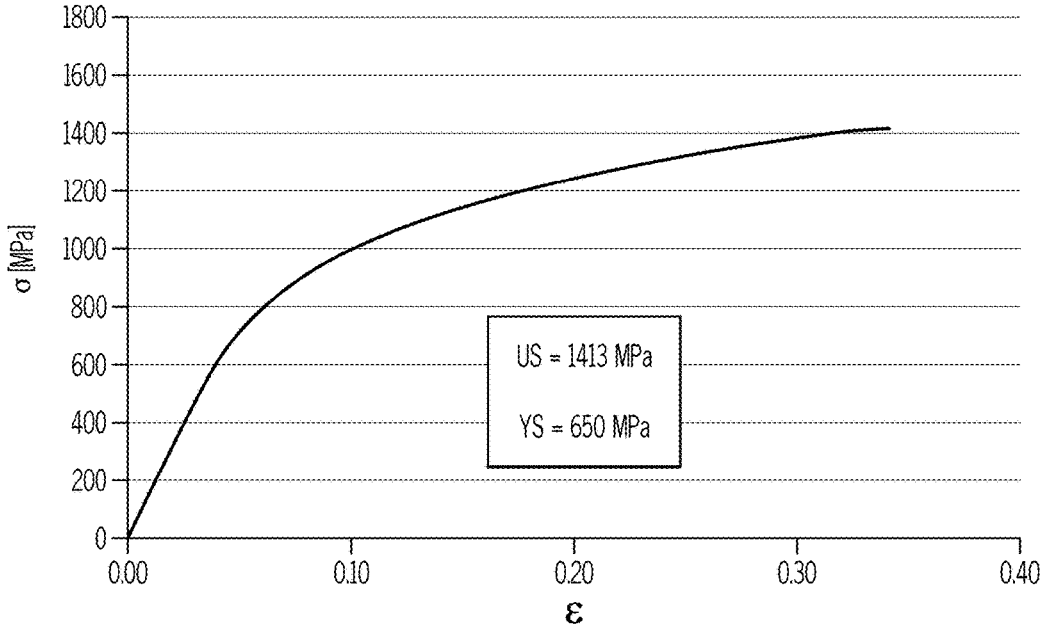
Figure 8D:
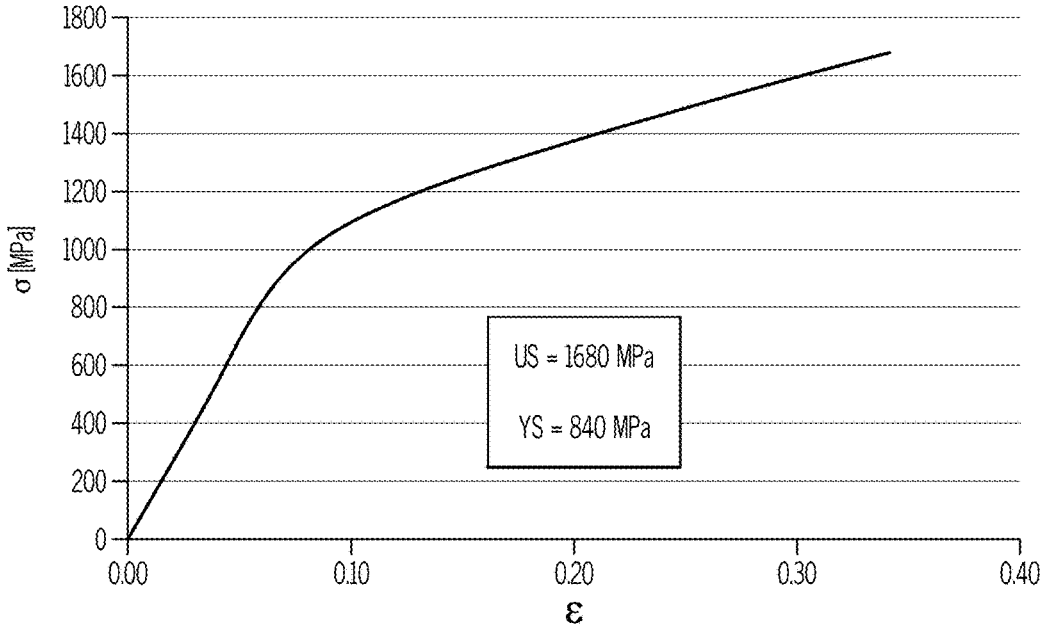

FIGS. 8C and 8D show stress-strain data under compression from two samples of the Example 1 alloy. The lower yield strength was 650 MPa, however, now an important plastic deformation regime was observed. In FIGS. 8A-8D, "US" indicates the stress values at which cracks started to be observed.

Figure 9A:
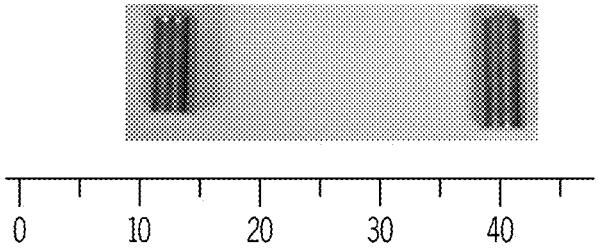
FIGS. 9A-9E are photographs of the samples used to generate the stress-strain curves of FIGS. 8A-8D, including the initial samples (FIG. 9A), tested samples having the disclosed multi-principle-element alloy composition (FIGS. 9D and 9E) and tested samples having a comparative example composition (FIGS. 9B and 9C)
Figure 9B:
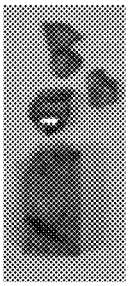
Figure 9C:
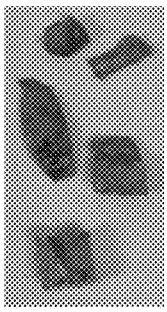
Figure 9D:
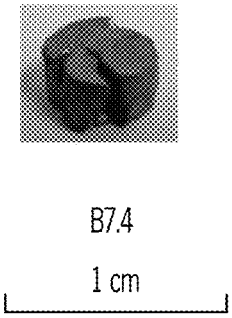
Figure 9E:
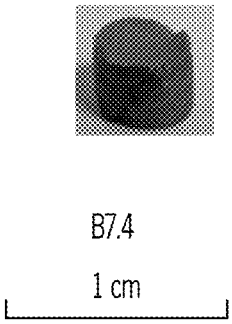

FIGS. 9A-9E show the machined samples for the compression tests (FIG. 9A); pieces of the Comparative Example alloy after the compression tests (FIGS. 9B and 9C); and pieces of the Example 1 alloy after the compression tests (FIGS. 9D and 9E). The important plastic deformation presented by the Example 1 alloy is clearly seen by inspection of FIGS. 9D and 9E.

The data scattering from different samples of the same alloy was somehow expected considering the initial preparation of these alloys by button arc-melting and the intrinsic heterogeneous as-cast microstructure. In general, the heterogeneities are not eliminated by only heat-treatments. To produce more homogeneous microstructures, subsequent plastic deformation processes steps, like warm/hot rolling may be applied.

Accordingly, the disclosed multi-principle-element alloy composition may be used in various high temperature applications, such as a substitute for nickel-based superalloys, such as Inconel 625.

Figure 10:
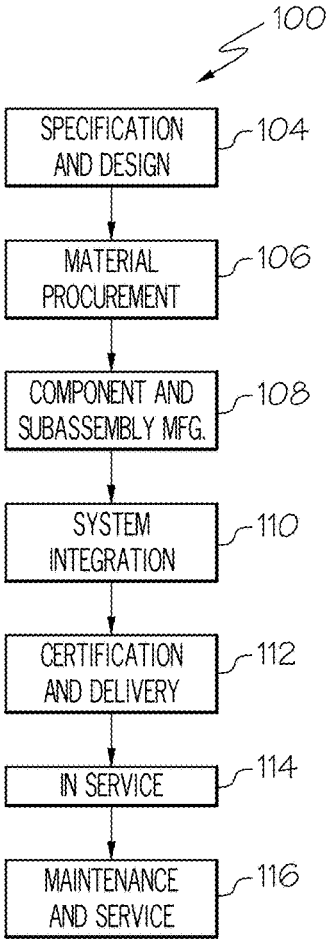
FIG. 10 is a flow diagram of an aircraft manufacturing and service methodology.
Figure 11:
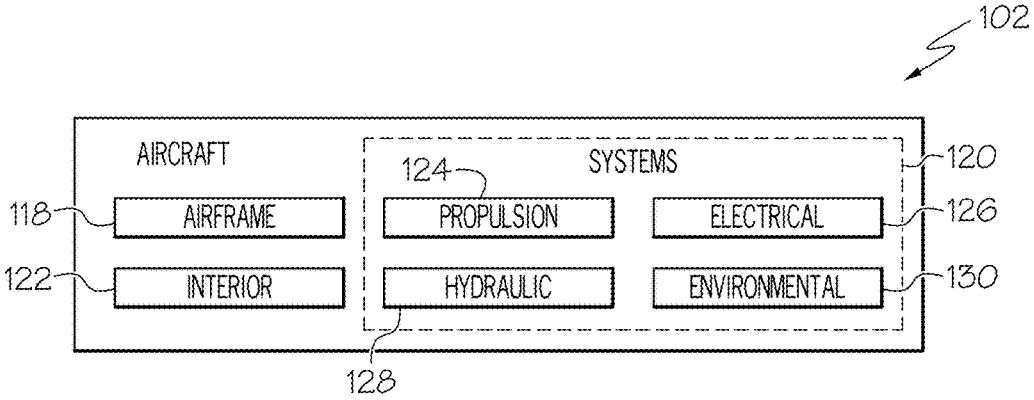
FIG. 11 is a block diagram of an aircraft.

Examples of the disclosure may be described in the context of an aircraft manufacturing and service method 100, as shown in FIG. 10, and an aircraft 102, as shown in FIG. 11. During pre-production, the aircraft manufacturing and service method 100 includes, for example, specification and design 104 of the aircraft 102 and material procurement 106. During production, component/subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116, which may also include modification, reconfiguration, refurbishment and the like.

Each of the processes of method 100 may be performed or carried out by a system integrator, a third party, and/or an operator (e.g., a customer). For the purposes of this description, a system integrator includes, without limitation, any number of aircraft manufacturers and major-system subcontractors; a third party includes, without limitation, any number of venders, subcontractors, and suppliers; and an operator may be an airline, leasing company, military entity, service organization, and so on.

As shown in FIG. 11, the aircraft 102 produced by example method 100 includes, for example, an airframe 118 with a plurality of systems 120 and an interior 122. Examples of the plurality of systems 120 include one or more of a propulsion system 124, an electrical system 126, a hydraulic system 128, and an environmental system 130. Any number of other systems may be included.

The disclosed multi-principle-element alloy composition may be employed during any one or more of the stages of the aircraft manufacturing and service method 100. As one example, components or subassemblies corresponding to component/subassembly manufacturing 108, system integration 110, and or maintenance and service 116 may be fabricated or manufactured using the disclosed multi-principle-element alloy composition. As another example, the airframe 118 may be constructed using the disclosed multi-principle-element alloy composition. Also, one or more apparatus examples, method examples, or a combination thereof may be utilized during component/subassembly manufacturing 108 and/or system integration 110, for example, by substantially expediting assembly of or reducing the cost of an aircraft 102, such as the airframe 118 and/or the interior 122. Similarly, one or more of system examples, method examples, or a combination thereof may be utilized while the aircraft 102 is in service, for example and without limitation, to maintenance and service 116.

The disclosed multi-principle-element alloy composition is described in the context of an aircraft; however, one of ordinary skill in the art will readily recognize that the disclosed multi-principle-element alloy composition may be utilized for a variety of applications. For example, the disclosed multi-principle-element alloy composition may be implemented in various types of vehicled including, for example, helicopters, passenger ships, automobiles, marine products (boat, motors, etc.) and the like.

Although various embodiments of the disclosed multi-principle-element alloy composition have been shown and described, modifications may occur to those skilled in the art upon reading the specification. The present application includes such modifications and is limited only by the scope of the claims.

What is claimed is:

1. An alloy composition comprising:
about 1 to about 9 atomic percent aluminum;
about 25 to about 33 atomic percent titanium;
about 10 to about 33 atomic percent vanadium;
about 5 to about 10 atomic percent zirconium; and
about 25 to about 33 atomic percent niobium.

2. The alloy composition of claim 1 wherein said aluminum is present at about 2 to about 8 atomic percent.

3. The alloy composition of claim 1 wherein said aluminum is present at about 3 to about 8 atomic percent.

4. The alloy composition of claim 1 wherein said titanium is present at about 27 to about 31 atomic percent.

5. The alloy composition of claim 1 wherein said titanium is present at about 28 to about 30 atomic percent.

6. The alloy composition of claim 1 wherein said vanadium is present at about 15 to about 30 atomic percent.

7. The alloy composition of claim 1 wherein said vanadium is present at about 20 to about 30 atomic percent.

8. The alloy composition of claim 1 wherein said zirconium is present at about 6 to about 10 atomic percent.

9. The alloy composition of claim 1 wherein said zirconium is present at about 6 to about 9 atomic percent.

10. The alloy composition of claim 1 wherein said niobium is present at about 27 to about 31 atomic percent.

11. The alloy composition of claim 1 wherein said niobium is present at about 28 to about 30 atomic percent.

12. The alloy composition of claim 1 consisting essentially of said aluminum, said titanium, said vanadium, said zirconium and said niobium.

13. An article formed from the alloy composition of claim 1.

14. The alloy composition of claim 1 consisting essentially of:
said aluminum at about 2 to about 8 atomic percent;
said titanium at about 27 to about 31 atomic percent;
said vanadium at about 15 to about 30 atomic percent;
said zirconium at about 6 to about 10 atomic percent; and
said niobium at about 27 to about 31 atomic percent.

15. The alloy composition of claim 14 wherein said aluminum is present at about 3 to about 8 atomic percent.

16. The alloy composition of claim 14 wherein said titanium is present at about 28 to about 30 atomic percent.

17. The alloy composition of claim 14 wherein said vanadium is present at about 20 to about 30 atomic percent.

18. The alloy composition of claim 14 wherein said zirconium is present at about 6 to about 9 atomic percent.

19. The alloy composition of claim 14 wherein said niobium is present at about 28 to about 30 atomic percent.

20. The alloy composition of claim 1 consisting essentially of:
said aluminum at about 3 to about 8 atomic percent;
said titanium at about 28 to about 30 atomic percent;
said vanadium at about 20 to about 30 atomic percent;
said zirconium at about 6 to about 9 atomic percent; and
said niobium at about 28 to about 30 atomic percent.

* * * * *